United States Patent [19]

Keane

[11] Patent Number: 4,618,195

[45] Date of Patent: Oct. 21, 1986

[54] VACUUM CLEANER HOSE COUPLING

[75] Inventor: James W. Keane, Ramsey County, Minn.

[73] Assignee: Whirlpool Corporation, Benton Harbor, Mich.

[21] Appl. No.: 740,623

[22] Filed: Jun. 3, 1985

[51] Int. Cl.[4] ..... H01R 13/73

[52] U.S. Cl. ..... 339/16 R; 285/7

[58] Field of Search ..... 339/15, 16 R; 174/47; 285/7, 320

[56] References Cited

U.S. PATENT DOCUMENTS

| | | | |
|---|---|---|---|
| 2,516,907 | 8/1950 | Penfold | 285/7 |
| 3,034,085 | 5/1962 | Pauler et al. | 339/16 |
| 3,127,227 | 3/1964 | Edwards | 339/15 |
| 3,314,039 | 4/1967 | Opper | 339/15 |
| 3,636,285 | 1/1972 | Wickham et al. | 200/51 R |
| 3,928,715 | 12/1975 | Holden | 174/47 |
| 4,012,091 | 3/1977 | Westergren | 339/15 |
| 4,018,493 | 4/1977 | Lyman et al. | 339/15 |
| 4,063,790 | 12/1977 | Kleykamp et al. | 339/16 R |
| 4,165,140 | 8/1979 | Lyman et al. | 339/15 |
| 4,188,081 | 2/1980 | Holden et al. | 339/15 |
| 4,211,457 | 7/1980 | Meadows | 339/15 |
| 4,283,594 | 8/1981 | Somers | 174/47 |
| 4,385,790 | 5/1983 | Genoa | 339/15 |
| 4,422,702 | 12/1983 | Nordeen | 339/15 |
| 4,473,923 | 10/1984 | Neroni et al. | 339/15 |
| 4,547,029 | 10/1985 | Kutnyak et al. | 339/16 R |

*Primary Examiner*—John McQuade

*Attorney, Agent, or Firm*—Wood, Dalton, Phillips, Mason & Rowe

[57] ABSTRACT

Structure for concurrently connecting an end of a vacuum cleaner hose to a canister suction inlet and an electrical power cord carried exteriorly of the hose and having at one end a first electrical connector associated with the hose end to a complementary second electrical connector associated with the canister. The connecting structure includes locking structure formed integrally with the hose end for releasably locking the hose end to the suction inlet to provide an air flow connection therebetween. Mounting structure is formed integrally with the hose end for removably mounting the first electrical connector to the hose end to be accurately aligned and engaged with the second electrical connector as an incident of locking association of the locking means to the suction inlet.

18 Claims, 5 Drawing Figures

FIG. 1
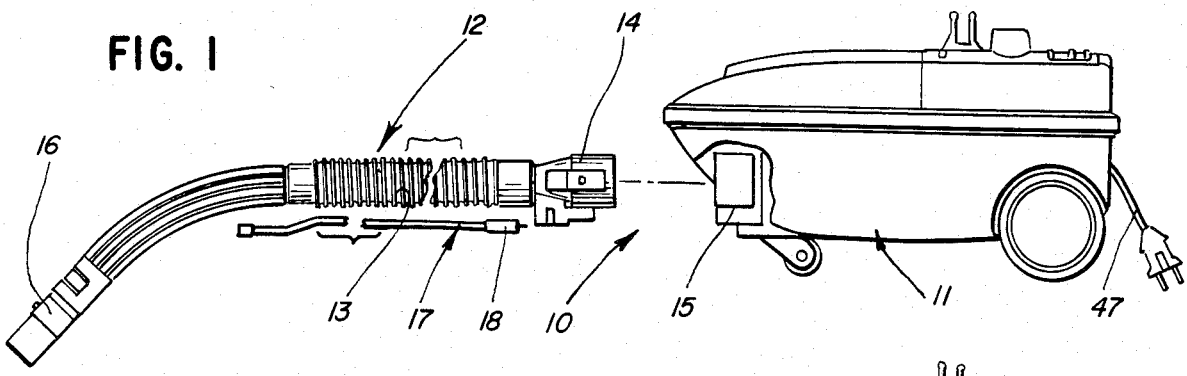
FIG. 2
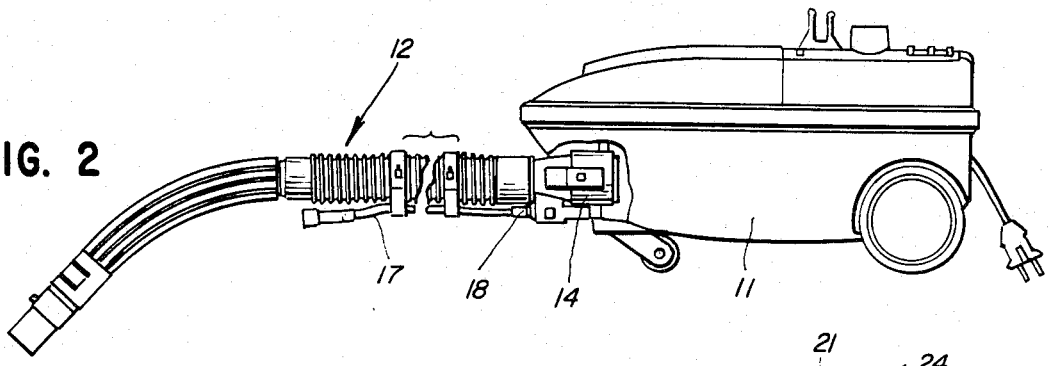
FIG. 3
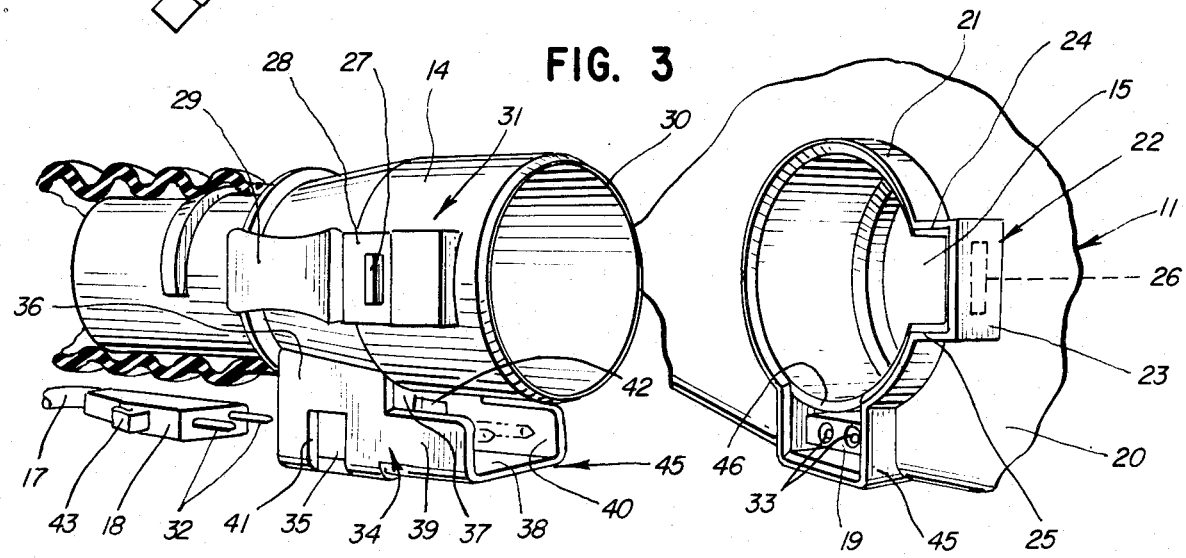
FIG. 4
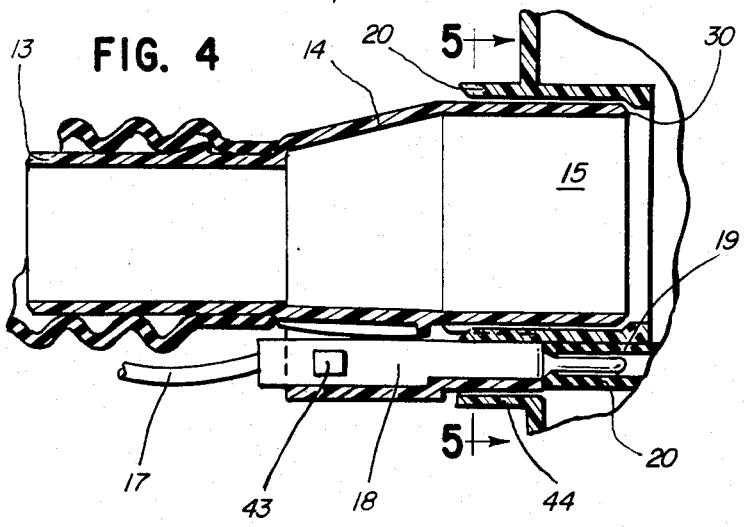
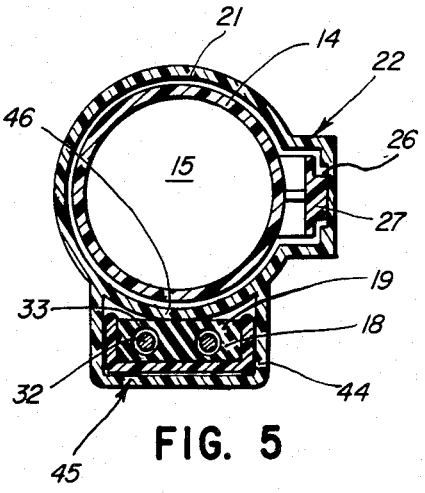
FIG. 5

VACUUM CLEANER HOSE COUPLING

BACKGROUND OF THE INVENTION

1. Field of the Invention

This invention relates to vacuum cleaners and in particular to means for connecting a hose end to a canister vacuum cleaner suction inlet and concurrently connecting an electrical power cord carried exteriorly of the hose to a receptacle carried by the canister vacuum cleaner.

2. Description of the Background Art

In U.S. Pat. No. 4,018,493 of John Bartholomew Lyman et al., which patent is owned by the assignee hereof, a vacuum cleaner hose end structure is provided which is arranged to retain an electrical connector in association with electrical terminals carried by the molded end portion of the flexible hose to provide a desired electrical terminal configuration which may be selectively male or female. The tube adapter includes a wall supporting the plug and retaining the distal end of the cord cover. The plug includes shoulders cooperating with the wall to retain the plug in its operative position. The terminals of the plug are automatically aligned for facilitated assembly by means of a key.

SUMMARY OF THE INVENTION

The present invention comprehends an improved vacuum cleaner structure for use with a hose having an electrical power cord carried exteriorly of the hose and having at one end a first electrical plug connector. The hose end is adapted to be connected to a suction inlet, such as provided in a canister, and the invention comprehends means for mounting the electrical plug connector on the hose end accurately so as to be engageable with a cooperating receptacle connector means of the canister when the hose end is connected in fluid flow communication with the canister suction inlet.

The invention further comprehends the provision of locking means formed integrally with the hose end for locking the hose end to the suction inlet of the canister to provide the desired air flow communication therebetween.

The invention comprehends forming the plug connector supporting means integrally with the hose end.

Thus, the invention permits the canister to be used with either an electric or nonelectric hose, as desired.

In the illustrated embodiment, the means for removably mounting the plug connector to the hose end comprises a U-section channel having opposed legs integrally connected to the hose end.

The legs are spaced apart a distance substantially equal to the width of the plug connector and the U-section channel defines a bight portion spaced from the hose end a distance substantially equal to the thickness of the plug connector so as to provide means for accurately embracing the plug connector end in the assembled arrangement thereof.

The plug connector mounting means defines a housing having a shoulder thereon with resilient retaining means carried by the plug connector engageable with the shoulder when the plug connector is fully installed in the housing for releasably retaining the plug connector therein.

More specifically, the housing defines an opening having an edge portion defining the retaining shoulder.

The opening further provides access to the resilient retaining means of the plug connector for manipulation thereof to permit selective removal of the plug connector from the plug connector housing when desired.

The hose end locking means is disposed adjacent the means for removably retaining the plug connector to the hose end.

The hose end locking means comprises a resilient locking tab on the hose end adapted to be received in a recess in the canister. Means are provided for manipulating the locking tab for selective disengagement thereof from the recess when desired.

The means for manipulating the locking means and the plug connector retaining means are resiliently biased in parallel directions when the plug connector is installed in the housing.

In the illustrated embodiment, the bight portion of the housing has a distal end cantilevered from the U-section channel extending toward the canister when the hose end is connected to the canister. The canister includes a projection received between the bight distal end and the hose end when the hose end is connected to the canister.

In the illustrated embodiment, the hose end defines a distal portion concentrically enclosed by the annular projection when the hose end is connected to the canister.

The annular projection defines a recess and the locking means comprises a resilient locking tab on the hose end received in the recess when the hose is connected to the canister.

Manipulating means are associated with the locking tab and are spaced from the distal portion of the hose end to be accessible when the distal end is disposed within the annular projection of the canister.

The annular projection further defines a guide portion defining means for guiding the locking tab into alignment with the recess as an incident of connection of the hose end to the canister.

The hose coupling structure of the present invention is extremely simple and economical of construction while yet providing for improved facilitated connection and disconnection to the canister of both nonelectrical hoses and hoses having electrical cords carried exteriorly thereof and provided at the end thereof with a suitable plug connector adapted to be connected to a complementary receptacle connector on the canister.

BRIEF DESCRIPTION OF THE DRAWING

Other features and advantages of the invention will be apparent from the following description taken in connection with the accompanying drawing wherein:

FIG. 1 is a fragmentary side elevation of a vacuum cleaner structure having a hose end connecting means embodying the invention;

FIG. 2 is a view similar to that of FIG. 1 but illustrating the connection of the hose end to the canister;

FIG. 3 is a fragmentary perspective view illustrating in greater detail the structure of the invention;

FIG. 4 is a fragmentary enlarged diametric section illustrating the connection of the hose end to the canister suction inlet and the concurrent connection of the electrical power cord plug connector on the hose end to the receptacle connector carried by the canister; and FIG. 5 is a transverse section taken substantially along the line 5—5 of FIG. 4.

BEST MODE FOR CARRYING OUT THE INVENTION

In the illustrative embodiment of the invention as disclosed in the drawing, a vacuum cleaner structure generally designated 10 is shown to comprise a wheeled canister 11 and a suction hose 12.

The suction hose defines a flexible midportion 13, a hose end 14 adapted to be connected to a suction inlet means 15 of the canister, and a distal connection end 16 adapted to be connected to a wand or the like (not shown).

The hose may be arranged to carry a power cord generally designated 17, such as for providing electrical power to apparatus connected to the connection end 16 of the hose. Illustratively, such electrical apparatus may comprise an electrically driven brush and beater bar assembly mounted in a conventional wand-manipulated nozzle. As shown in FIG. 1, the power cord is carried exteriorly of the hose and includes a plug connector 18 at one end adapted to be connected to a complementary receptacle connector 19 carried by the canister housing 20, as shown in FIG. 3.

Suction inlet 15 of canister 11, as seen in FIG. 3, is defined by an outwardly projecting annular wall 21 which is adapted to snugly receive the tubular hose end 14 in the connected arrangement thereof, as illustrated in FIG. 4.

Annular wall 21 is provided with a U-shaped offset portion 22 defining a bight 23 and opposite legs 24 and 25. The bight is provided with a recess 26 adapted to receive a boss 27 on a resilient locking tab 28 having a distal locking tab manipulating portion 29. When hose end 14 is inserted into the suction inlet 15, the boss moves into alignment with the recess 26 and is biased outwardly thereinto to releasably retain the hose end in coupled association with the suction inlet of the canister.

Manipulating portion 29 extends substantially away from the distal end 30 of hose end 14 so as to be accessible exteriorly of the suction inlet when the hose end is coupled thereto, thereby permitting the user to disengage the boss 27 from recess 26, when desired, and permit withdrawal of the hose end from the suction inlet.

As shown in FIG. 3, the hose end retaining means generally designated 31 defined by the boss 27, locking tab 28 and manipulating means 29 may be integrally molded with the hose end.

Power cord plug 18, in the illustrated embodiment as best seen in FIG. 3, may define a male plug connector having a pair of projecting terminals 32 adapted to be received in female terminals 33 of the canister-mounted receptacle connector 19. The invention comprehends the provision of a housing generally designated 34 also formed integrally with the hose end 14 for releasably mounting plug connector 18 to the hose end to be in accurate alignment with the receptacle connector 19 carried by the canister as an incident of the connection of the hose end 14 to the suction inlet 15.

Thus, as seen in FIG. 3, housing 34 comprises a U-shaped housing having a bight portion 35 and opposite legs 36 and 37 integrally connected to the hose end at the end of the housing remote from the hose end distal portion 30. The forward end 38 of bight 35 is cantilevered forwardly, with the housing leg portions 39 and 40 extending only partially toward the hose end so as to provide clearance for the lower portion 46 of the annular wall 21 when the hose end is installed in the suction inlet 15.

Housing legs 36 and 37 further define through openings 41 and 42 for receiving resiliently outwardly biased spring retaining elements 43 on the plug connector 18 when the plug connector is fully installed in the housing 34, i.e. in the disposition of FIG. 4. As seen in FIG. 3, openings 41 and 42 are disposed adjacent the hose end locking means 31.

The U-shaped projection defined by leg ends 39 and 40 and bight end 38 is adapted to be fitted into a complementary U-shaped projecting wall 44 on the canister housing 20. As seen in FIG. 5, the cantilevered U-shaped projection generally designated 45 defined by housing portions 38, 39 and 40 is snugly received in the space defined by the wall 44 and the annular wall portion 46, thereby serving as guide means for facilitating alignment of the terminals 32 of plug connector 18 with the female terminals 33 of the receptacle connector 19.

Thus, the invention comprehends an improved vacuum cleaner structure wherein a power cord carried exteriorly of the suction hose may automatically have its connecting plug connector guided into connected association with a complementary receptacle connector carried by the canister so as to provide electrical power from the canister to the power cord 17 associated with the hose. As shown in FIG. 1, power may be provided to the canister from a suitable power source through a conventional canister power cord 47. At the same time, the hose end defines integral means for releasably locking the hose end to cooperating locking means on the canister. The means on the hose end for positioning the power cord plug connector 18 is preferably formed integrally therewith as by forming the entire hose end structure as a molded synthetic resin element.

The cooperating locking elements 43, 41 and 42 for releasably retaining the plug in the housing 34 effectively define inner acting shoulder portions which may be selectively disengaged as a result of the resiliency of the retaining elements 43. Similarly, the cooperating boss 27 on the hose end and recess 26 on the canister define cooperating shoulders which may be selectively disengaged by the resiliency of the locking means 31 to permit disengagement of the hose end from the canister while retaining the plug connector 28 in the housing 34.

The foregoing disclosure of specific embodiments is illustrative of the broad inventive concepts comprehended by the invention.

I claim:

1. Structure for concurrently connecting an end of a vacuum cleaner hose to a suction inlet of a canister, and an electrical power cord carried exteriorly of the hose and having at one end a first electrical connector associated with the hose end to a complementary second electrical connector associated with the canister, the connecting structure comprising:

locking means formed integrally with said hose end for releasably locking said hose end to said suction inlet to provide an air flow communication therebetween; and means formed integrally with said hose end for removably mounting said first electrical connector to said hose end to be accurately aligned and engaged with said second electrical connector as an incident of locking association of said locking means to said suction inlet.

2. The vacuum cleaner connecting structure of claim 1 wherein said means for removably mounting said first connector to said hose end comprises a U-section channel having opposed legs integrally connected to said hose end.

3. The vacuum cleaner connecting structure of claim 1 wherein said means for removably mounting said first connector to said hose end comprises a U-section channel having opposed legs integrally connected to said hose end and spaced apart a distance substantially equal to the width of said first connector.

4. The vacuum cleaner connecting structure of claim 1 wherein said means for removably mounting said first connector to said hose end comprises a U-section channel having a bight portion spaced from said hose end a distance substantially equal to the thickness of said first connector.

5. The vacuum cleaner connecting structure of claim 1 wherein said means for removably mounting said first connector to said hose end comprises a U-section channel having opposed legs integrally connected to said hose end and spaced apart a distance substantially equal to the width of said first connector and a bight portion spaced from said hose end a distance substantially equal to the thickness of said first connector.

6. Structure for concurrently connecting an end of a vacuum cleaner hose to a suction inlet of a canister and an electrical power cord carried exteriorly of the hose and having at one end a first electrical connector associated with the hose end to a complementary second electrical connector associated with the canister, the connecting structure comprising:

locking means formed integrally with said hose end for releasably locking said hose end to said suction inlet to provide an air flow communication therebetween;

a plug housing formed integrally with said hose end for removably mounting said first electrical connector to said hose end to be accurately aligned and engaged with said second electrical connector as an incident of locking association of said locking means to said suction inlet, said plug housing having a shoulder thereon; and resilient retaining means carried by the first connector to be engaged with said shoulder when the first connector is fully installed in said housing for releasably retaining the first connector therein.

7. The vacuum cleaner connecting structure of claim 6 wherein said housing defines an opening having an edge portion defining said shoulder.

8. The vacuum cleaner connecting structure of claim 6 wherein said housing defines a through opening having an edge portion defining said shoulder.

9. Structure for concurrently connecting an end of a vacuum cleaner hose to a suction inlet of a canister and an electrical power cord carried exteriorly of the hose and having at one end a first electrical connector associated with the hose end to a complementary second electrical connector associated with the canister, the connecting structure comprising:

locking means formed integrally with said hose end for releasably locking said hose end to said suction inlet to provide an air flow communication therebetween; and means formed integrally with said hose end for removably mounting said first electrical connector to said hose end to be accurately aligned and engaged with said second electrical connector as an incident of locking association of said locking means to said suction inlet, said locking means being disposed adjacent said means for removably mounting said first connector to said hose end.

10. The vacuum cleaner connecting structure of claim 9 wherein said locking means comprises a resilient locking tab on said hose end having a boss adapted to be received in a recess in said canister, and means for manipulating said locking tab for selective disengagement of said hose from said recess.

11. The vacuum cleaner connecting structure of claim 9 wherein said locking means comprises a resilient locking tab on said hose end having a boss adapted to be received in a recess in said canister, and means for manipulating said locking tab for selective disengagement of said hose from said recess, said first electrical connector having resiliently biased retaining means engageable with said mounting means, said retaining means and said means for manipulating said locking tab being resiliently biased in parallel directions when the first electrical connector is installed in said mounting means.

12. Structure for concurrently connecting an end of a vacuum cleaner hose to a suction inlet of a canister, and an electrical power cord carried exteriorly of the hose and having at one end a first electrical connector associated with the hose end to a complementary second electrical connector associated with the canister, the connecting structure comprising:

locking means formed integrally with said hose end for releasably locking said hose end to said suction inlet to provide an air flow communication therebetween; and means for removably mounting said first electrical connector to said hose end to be accurately aligned and engaged with said second electrical connector as an incident of locking association of said locking means to said suction inlet, said connector mounting means comprising a U-section channel having opposed legs integrally connected to said hose end and spaced apart a distance substantially equal to the width of said first connector and a bight portion spaced from said hose end a distance substantially equal to the thickness of said first connector, said bight portion having a distal end cantilevered from said U-section channel toward said canister when the hose end is connected to said canister.

13. The vacuum cleaner connecting structure of claim 12 wherein said canister includes a projection received between said bight distal end and the hose end when the hose end is connected to the canister.

14. The vacuum cleaner connecting structure of claim 12 wherein said canister includes an annular projection having a portion received between said bight distal end and the hose end when the hose end is connected to the canister.

15. The vacuum cleaner connecting structure of claim 12 wherein said canister includes an annular projection having a portion received between said bight distal end and the hose end when the hose end is connected to the canister, said hose end defining a distal portion concentrically enclosed by said annular projection when said hose end is connected to the canister.

16. The vacuum cleaner connecting structure of claim 12 wherein said canister includes an annular projection having a portion received between said bight distal end and the hose end when the hose end is connected to the canister, said hose end defining a distal portion concentrically enclosed by said annular projection when said hose end is connected to the canister, said annular projection defining a recess, said locking means comprising a resilient locking tab on said hose end and having a boss received in said recess when the hose end is connected to the canister, and means for manipulating said locking tab for selective disengagement of said boss from said recess.

17. The vacuum cleaner connecting structure of claim 12 wherein said canister includes an annular projection having a portion received between said bight distal end and the hose end when the hose end is connected to the canister, said hose end defining a distal portion concentrically enclosed by said annular projection when said hose end is connected to the canister, said annular projection defining a recess, said locking means comprising a resilient locking tab on said hose end and having a boss received in said recess when the hose end is connected to the canister, and means for manipulating said locking tab for selective disengagement of said boss from said recess, said manipulating means being spaced from said distal portion of the hose end to be accessible when said distal end is disposed within said annular projection on the canister.

18. The vacuum cleaner connecting structure of claim 12 wherein said canister includes an annular projection having a portion received between said bight distal end and the hose end when the hose end is connected to the canister, said hose end defining a distal portion concentrically enclosed by said annular projection when said hose end is connected to the canister, said annular projection defining a recess, said locking means comprising a resilient locking tab on said hose end and having a boss received in said recess when the hose end is connected to the canister, and means for manipulating said locking tab for selective disengagement of said boss from said recess, said annular projection further defining guide portions defining means for guiding said locking tab into alignment with said recess as an incident of connection of said hose end to said canister.

* * * * *